United States Patent [19]

Kamei

[11] Patent Number: 4,964,836

[45] Date of Patent: Oct. 23, 1990

[54] POSEABLE TOY ANIMAL

[75] Inventor: Masato Kamei, Tokyo, Japan

[73] Assignee: Bandai America Incorporated, Cerritos, Calif.

[21] Appl. No.: 467,960

[22] Filed: Jan. 22, 1990

[51] Int. Cl.[5] ..... A63H 3/04; A63H 3/02; A63H 3/46

[52] U.S. Cl. ..... 446/374; 446/370; 446/382

[58] Field of Search ..... 446/374, 373, 375, 370, 446/371, 369, 376, 379, 380, 382, 383, 390

[56] References Cited

U.S. PATENT DOCUMENTS

| | | | |
|---|---|---|---|
| 1,626,533 | 4/1927 | Hergershausen | 446/374 |
| 2,193,522 | 3/1940 | Ross | 446/374 |
| 3,284,947 | 11/1966 | Dahl | 446/374 |
| 3,325,939 | 6/1967 | Ryan et al. | 446/374 |
| 3,624,691 | 11/1971 | Robson | 446/374 |
| 4,136,484 | 1/1979 | Abrams | 446/370 |
| 4,197,358 | 4/1980 | Garcia | 446/374 X |

FOREIGN PATENT DOCUMENTS

| | | | |
|---|---|---|---|
| 1307454 | 9/1962 | France | 446/374 |
| 2387674 | 12/1978 | France | 446/370 |
| 1571352 | 7/1980 | United Kingdom | 446/370 |
| 1585330 | 2/1981 | United Kingdom | 446/374 |
| 2197800 | 6/1988 | United Kingdom | 446/373 |

*Primary Examiner*—Robert A. Hafer
*Assistant Examiner*—D. Neal Muir
*Attorney, Agent, or Firm*—R. Gale Rhodes, Jr.

[57] ABSTRACT

A poseable toy animal including at least a pair of flexible limbs formed in part by skeletal-like structure including a pair of flexible members extending downwardly from a generally inverted U-shaped frame including a pair of downwardly extending support members and formed in part by flexible material surrounding the flexible members and which flexible members and flexible material may be bent into different shapes to provide the animal with different poses.

7 Claims, 2 Drawing Sheets

POSEABLE TOY ANIMAL

This invention relates to a poseable toy animal including at least two flexible legs which may be bent into different shapes to provide the animal with different poses.

Numerous toy animals in the shapes of horses, dogs, cows, cats, humans, etc., are known to the art including arms and legs which may be bent into different shapes. Many of these prior art toys include arms and legs including articulated joints and arms and legs of plastic material and the like which may be bent to provide the animal with different poses.

However, there exists in the art a new and improved posable toy animal including at least a pair of flexible limbs, such as a pair of flexible legs, which may be bent into different shapes to provide the animal with different poses and which may be manufactured inexpensively and sold inexpensively.

In summarizing the present invention, it will be understood to be a poseable toy animal including at least a pair of flexible limbs formed in part by skeletal-like structure including a pair of flexible wires extending downwardly from a generally inverted U-shaped frame including a pair of downwardly extending support members and formed in part by flexible material surrounding the flexible wires which flexible wires and which flexible material may be bent into different shapes to provide the animal with different poses.

The preferred embodiment of the poseable toy animal of the present invention is illustrated in the drawings wherein.

Figure 1:
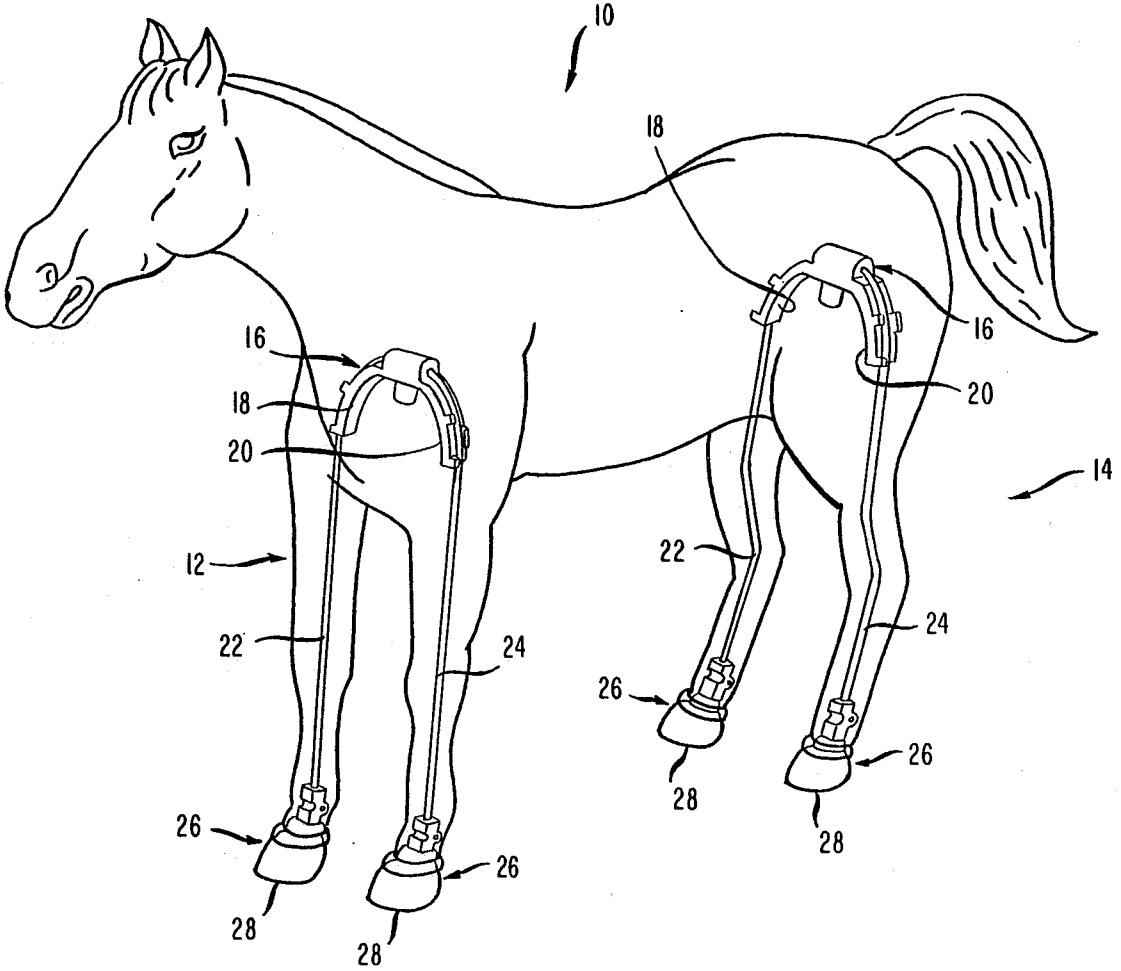
FIG. 1 is a perspective view of an embodiment of the poseable toy animal of the present invention shown embodied as a poseable toy horse and showing the skeletal-like structure of the present invention, providing in part the limbs or pairs of legs of the horse, superimposed on the horse.

The poseable toy animal of the present invention is shown embodied in FIG. 1 as a poseable toy horse 10 including a front pair of flexible limbs or legs indicated generally by numerical designation 12 and a rear pair of flexible limbs or legs indicated generally by numerical designation 14. It will be understood generally, and as taught in detail below, that the pairs of flexible legs 12 and 14, and each leg thereof, may be bent into different shapes to provide the poseable horse 10 with different poses.

It will be further understood that the structure of each pair of flexible legs 12 and 14 is the same and hence the numerical designations of the components of such structure are the same for both the front and rear pair of flexible legs 12 and 14 as shown in FIG. 1.

Figure 2:
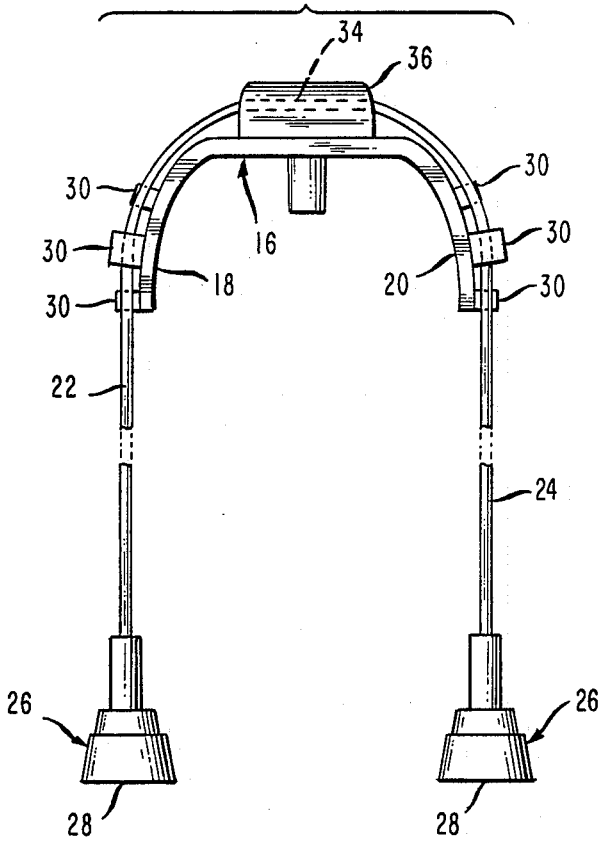
FIG. 2 is a front elevational view of the skeletal-like structure of the present invention.

More particularly, and referring to FIGS. 1 and 2, it will be understood that each pair of flexible legs 12 and 14 is comprised of skeletal-like structure including a generally inverted U-shaped frame 16 including a pair of downwardly extending support members 18 and 20 and a pair of flexible wires 22 and 24 each extending a first distance downwardly along the outside portion of one of the support members 18 or 20 and extending a second distance downwardly therefrom and being secured to a foot indicated by general numerical designation 26 including a horse's hoof 28.

Figure 3:
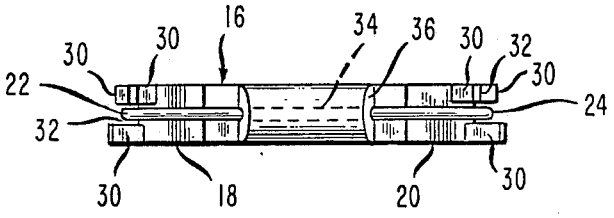
FIG. 3 is a top view of the structure shown in FIG. 2.
Figure 4:
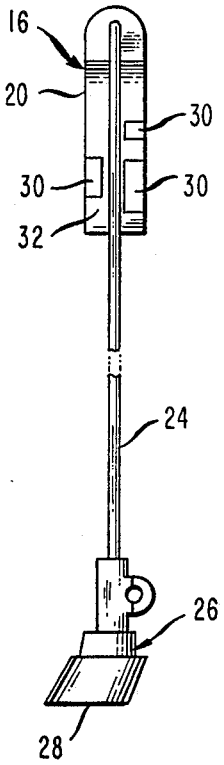
FIG. 4 is a right side view of the structure shown in FIG. 2.

From FIGS. 2–4, it will be understood that the outer portions of the downwardly extending support members 18 and 20 are each provided with a plurality of generally opposed and longitudinally spaced apart outwardly extending members 30 forming generally a channel 32 therebetween for receiving the flexible wires 22 and 24 as may be best understood by reference to FIG. 4. It will be still further understood that the flexible wires 22 and 24, as indicated in FIGS. 2 and 3, may be comprised of a single wire including a central portion 34, shown in dashed outline in FIGS. 2 and 3, secured to an upwardly extending member 36 comprising a part of the generally inverted U-shaped frame 16. In actual practice, the wires 22 and 24, comprised of the single wire shown, may be secured to the upwardly extending member 36 of the frame 16 by molding the frame 16, particularly the upwardly extending member 36, around the single wire comprising the pair of wires 22 and 24 with the frame 16 being injection molded from a suitable plastic, such as ADS plastic.

Referring again to FIG. 1, and in accordance with the further teachings of the present invention, it will be understood that the body of the poseable toy horse 10 may be suitably molded from a suitable flexible plastic, such as polyvinyl chloride, in the shape of the horse 10 as shown with parts or portions of the body of flexible plastic molded around the U-shaped frames 16, the pairs of downwardly extending support members 18 and 20, and the pair of flexible wires 22 and 24 with the portions of the flexible plastic surrounding the lower downwardly extending flexible wires 22 and 24, as shown in FIG. 1, and such downwardly extending portions of the flexible wires 22 and 24, comprising pairs of flexible limbs or legs 12 and 14. It will be understood that such pairs of flexible legs 12 and 14 may be bent into different shapes to provide the poseable toy horse 10 with different poses.

As used herein and in the appended claims, it will be understood that the term "flexible" is used to mean that the flexible legs 12 and 14 may be bent into different shapes without breaking the legs and that the flexible legs when bent into a particular shape will remain in such shape until the legs are bent into a different shape to provide the toy horse 10 with a different pose.

It will be still further understood that the poseable toy animal of the present invention may be embodied in other shapes or animals other than the horse 10 of FIG. 1, such as cows, sheep, and the like, and that the poseable toy animal of the present invention may be embodied as a human animal having flexible limbs comprising the human legs and arms and that such flexible limbs may terminate in either a hand or a foot other than the horse's foot 26 as shown in FIG. 1.

Lastly, it will be understood that many variations and modifications may be made in the present invention without departing from the spirit and the scope thereof.

What is claimed is:

1. A poseable toy animal including at least a first pair of flexible limbs, comprising:

(a) skeletal-like structure including:

(i) a generally inverted U-shaped frame including two downwardly extending support members; and (ii) a pair of longitudinally extending flexible members each extending a first predetermined distance downwardly along, and a second predetermined distance downwardly from, one of said downwardly extending support members, said flexible members having lower portions;

(b) a body of flexible material in the shape of said animal formed in part around said inverted U-shaped frame, said two downwardly extending support members and said pair of longitudinally extending flexible members including said lower portions, the part of said flexible material formed around said lower portions of said pair of longitudinally extending flexible members and said lower portions of said pair of longitudinally extending flexible members substantially comprising said first pair of flexible limbs of said animal;

(c) said pair of said flexible material formed around said lower portions of said pair of longitudinally extending flexible members and said lower portions of said pair of longitudinally extending flexible members bendable into different shapes to provide said animal with different poses; and each of said downwardly extending support members having an outer portion provided with a plurality of generally opposed and longitudinally spaced apart outwardly extending members forming generally a channel therebetween for receiving one of said longitudinally extending flexible members.

2. The poseable toy animal according to claim 1 wherein said pair of longitudinally extending flexible members are comprised of a single longitudinally extending flexible wire having a central portion, and wherein said U-shaped frame includes an upwardly extending member secured to said central portion.

3. The poseable toy animal according to claim 1 wherein said animal further comprises a second pair of flexible limbs the same as said first pair of flexible limbs claimed in claim 1.

4. The poseable toy animal according to claim 3 wherein each of said longitudinally extending members terminates in an end and wherein said poseable toy animal further comprises one of a hand or foot secured to said end.

5. The poseable toy animal according to claim 4 wherein said poseable toy animal is a toy horse, wherein said pairs of flexible limbs are front and rear pairs of legs and wherein said one of a hand or foot is a horse's foot including a horse's hoof.

6. The poseable toy animal according to claim 1 wherein said body of flexible material is a plastic material molded in part around said inverted U-shaped frame including said pair of longitudinally extending flexible members.

7. The poseable toy animal according to claim 6 wherein said plastic material is polyvinyl chloride.

* * * * *